US009033767B2

(12) United States Patent
Schadow

(10) Patent No.: US 9,033,767 B2
(45) Date of Patent: May 19, 2015

(54) RUN-OFF SECURING DEVICE

(75) Inventor: Joachim Schadow, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 242 days.

(21) Appl. No.: 13/636,308

(22) PCT Filed: Feb. 10, 2011

(86) PCT No.: PCT/EP2011/051928

§ 371 (c)(1),
(2), (4) Date: Sep. 20, 2012

(87) PCT Pub. No.: WO2011/120730

PCT Pub. Date: Oct. 6, 2011

(65) Prior Publication Data

US 2013/0009368 A1 Jan. 10, 2013

(30) Foreign Application Priority Data

Mar. 29, 2010 (DE) ..... 10 2010 013 102

(51) Int. Cl.
*B24B 55/00* (2006.01)
*B24B 23/02* (2006.01)
*B24B 45/00* (2006.01)

(52) U.S. Cl.
CPC ..... *B24B 23/028* (2013.01); *B24B 45/006* (2013.01); *B24B 55/00* (2013.01)

(58) Field of Classification Search
USPC ..... 451/359, 360, 342, 508
See application file for complete search history.

(56) References Cited

U.S. PATENT DOCUMENTS

| | | | | |
|---|---|---|---|---|
| 4,637,170 | A * | 1/1987 | Block | 451/342 |
| 4,980,994 | A * | 1/1991 | Helm et al. | 451/342 |
| 5,464,365 | A | 11/1995 | Kirn | |
| 6,116,996 | A * | 9/2000 | Yanase | 451/359 |
| 6,887,142 | B2 * | 5/2005 | Rupprecht et al. | 451/359 |
| 7,972,199 | B2 * | 7/2011 | Blatz et al. | 451/359 |

FOREIGN PATENT DOCUMENTS

| | | | |
|---|---|---|---|
| CN | 1366483 | A | 8/2002 |
| CN | 1630571 | A | 6/2005 |
| DE | 41 31 514 | A1 | 3/1993 |
| DE | 44 26 969 | A1 | 2/1996 |

OTHER PUBLICATIONS

International Search Report corresponding to PCT Application No. PCT/EP2011/051928, mailed May 20, 2011 (German and English language document) (5 pages).

* cited by examiner

*Primary Examiner* — Robert Rose
(74) *Attorney, Agent, or Firm* — Maginot, Moore & Beck LLP

(57) ABSTRACT

A run-off securing device, in particular a run-off securing device of a handheld power tool, is configured to avoid running off of a clamping element and/or a tool from a spindle. The device has at least one transmission unit, which is removably coupled to the spindle and has at least one first transmission element and at least one second transmission element. The at least one second transmission element is movable in relation to the at least one first transmission element. The transmission unit has at least one movement changing unit, which at least partially transforms a first relative movement between the at least one first transmission element and the at least one second transmission element into a second relative movement in a braking mode.

14 Claims, 6 Drawing Sheets

RUN-OFF SECURING DEVICE

This application is a 35 U.S.C. §371 National Stage Application of PCT/EP2011/051928, filed on Feb. 10, 2011, which claims the benefit of priority to Serial No. DE 10 2010 013 102.4, filed on Mar. 29, 2010 in Germany, the disclosures of which are incorporated herein by reference in their entirety.

BACKGROUND

Run-off securing devices, for preventing a clamping element and/or a tool from running off a spindle, are already known. The run-off securing devices comprise a transmission unit, which has a first transmission element and has a second transmission element that is movable relative to the first transmission element. In these cases, the transmission unit is provided to be coupled to the spindle in a removable manner.

SUMMARY

The disclosure is based on a run-off securing device, in particular a run-off securing device of a hand power tool, configured to prevent a clamping element and/or a tool from running off a spindle, comprising at least one transmission unit, which is provided to be coupled to the spindle in a removable manner and which has at least one first transmission element and has at least one second transmission element that is movable relative to the first transmission element.

It is proposed that the transmission unit has at least one motion changing unit, which is provided to at least partially transform a first relative motion between the first transmission element and the second transmission element into a second relative motion in a braking mode. A "clamping element" is intended here to define, in particular, a clamping nut or a clamping flange configured to screw onto the spindle or to unscrew therefrom. The clamping nut or clamping flange is provided to clamp the tool axially against the transmission unit. A "transmission unit" is to be understood here to mean, in particular, a unit comprising at least two components and provided to transmit forces and/or torques from an output, in particular a spindle of a hand power tool, to a tool. In this context, "provided" is to be understood to mean, in particular, specially equipped and/or specially designed. "Removable" is to be understood here to mean, in particular, a decoupling of the transmission unit from the spindle, wherein a functionality of the transmission unit, in particular a relative motion between the first transmission element and the second transmission element, is maintained in decoupled state. The transmission unit in this case is secured to the spindle in a removable manner via a positive connection and/or non-positive connection such as, for example, via a retaining ring. A "motion changing unit" is intended here to define, in particular, a unit comprising a mechanism, in particular a thread or another mechanism considered appropriate by persons skilled in the art, with which one type of motion such as, for example, a rotation is converted into another type of motion such as, for example, a translation. A "braking mode" is to be understood here to be, in particular, a mode of a hand power tool, in particular of a spindle of the hand power tool, in which the spindle is braked by a braking device, such that coasting down of the spindle, as for example in the case of an interruption in the electric power supply to an electric motor, is advantageously prevented, at least to a large extent.

In the case of the braking mode, mass moments of inertia of the tool, in particular of the disk-shaped tool, result in a relative motion between the tool fastened on the spindle, the run-off securing device and a clamping nut provided to chuck the tool on the spindle. The relative motion between the tool and the clamping nut result in the clamping nut becoming undone and thus being able to run off the spindle. The run-off securing device according to the disclosure, advantageously prevents the clamping nut from running off the spindle in such a manner, and consequently prevents the tool from becoming detached from the spindle. Further, owing to the fact that the run-off securing device according to the disclosure, in particular the transmission unit, is removable, it is possible, particularly advantageously, to achieve a high flexibility and consequently a large range of application for the run-off securing device according to the disclosure.

Advantageously, the first relative motion between the first transmission element and the second transmission element is a rotation, and the second relative motion is a translation. It is thus possible, in a particularly advantageous and structurally simple manner, to prevent the clamping nut from running off the spindle as a result of the relative motion between the tool fastened on the spindle, the run-off securing device and the clamping nut, since, particularly advantageously, a clamping force to chuck the tool and the clamping nut on the spindle is generated by the second relative motion between the first transmission element and the second transmission element.

Further, it is proposed that the first transmission element is movably mounted in the second transmission element. The expression "mounted in" is intended here to mean, in particular, a spatial disposition of the first transmission element in the second transmission element. Preferably, the first transmission element is a disk, and the second transmission element is a pot, such that the first transmission element is received by the second transmission element. A disposition of the first transmission element in the second transmission element makes it possible to achieve an advantageous self-centering of the first transmission element and of the second transmission element. In this case, an extent of the first transmission element in a plane running parallel to a tool-side bearing contact surface of the first transmission element is less than an extent of the second transmission element, which extent likewise runs in a plane parallel to the tool-side bearing contact surface of the first transmission element. Advantageously, structural space is saved, such that, particularly advantageously, a compact run-off securing device is achieved.

Furthermore, it is proposed that the motion changing unit is a stroke unit, which is provided to move the first transmission element as a result of the first relative motion relative to the second transmission element, along an axial direction. A "stroke unit" is to be understood here to mean a unit comprising at least two components, by which a motion of one element, in particular of the first transmission element, along a straight path, in particular along the spindle, is generated. An "axial direction" is to be understood here to mean, in particular, a direction along a rotation axis of the first transmission element or of the second transmission element. The configuration according to the disclosure, advantageously generates an axial stroke of the first transmission element relative to the second transmission element.

In a preferred configuration, the stroke unit has at least one first stroke element, which is at least partially integral with the first transmission element or with the second transmission element. Advantageously, savings are made on structural space, assembly work and costs.

Further, it is proposed that the first stroke element is in the form of a ramp. "In the form of a ramp" is to be understood here to mean, in particular, a geometric shape that has a pitch along a path going from a start point in the direction of an end point, such that a height difference exists between the start point and the end point. Advantageously, the stroke unit has at least one second stroke element, which generates the second relative motion as a result of the first relative motion by an action in combination with the first stroke element. Particularly preferably, the first stroke element is integral with the second transmission element, and the second stroke element is integral with the first transmission element. It is also conceivable, however, for the first stroke element to be integral with the first transmission element, and for the second stroke element to be integral with the second transmission element. In this case, the second stroke element is in the form of a ramp, such that, by a rotation of the first transmission element relative to the second transmission element, the first stroke element in the form of a ramp slides along on the second stroke element in the form of a ramp. It is also conceivable, however, for the second stroke element to be a roll body and to be able to roll on the first stroke element in the form of a ramp. A pitch of the first stroke element and/or of the second stroke element is preferably as great as or greater than a pitch of a thread of the clamping nut and the spindle onto and from which the clamping nut is screwed on and off. The pitch of the first stroke element and/or of the second stroke element in this case corresponds, in particular, to 100 to 150% of the pitch of the thread of the clamping nut and of the spindle, preferably to 110 to 140% of the pitch of the thread of the clamping nut and of the spindle, and particularly preferably to 120 to 130% of the pitch of the thread of the clamping nut and of the spindle.

In an alternative embodiment of the run-off securing device according to the disclosure, it is conceivable, to generate an axial stroke between the first transmission element and the second transmission element, that a stroke element of the stroke unit is a roll body that, in the case of a rotation of the first transmission element relative to the second transmission element, rolls along a stroke element in the form of a ramp. The configuration of the run-off securing device according to the disclosure enables a clamping force configured to prevent a clamping nut from running off the spindle to be generated in a structurally simple manner.

Furthermore, it is proposed that the second transmission element, when in a mounted state, is positively connected to the spindle to transmit torque. Other connection techniques considered appropriate by persons skilled in the art are also conceivable.

Advantageously, a torque is transmitted from the second transmission element, via the first transmission element, to the tool disposed on the spindle and chucked by the clamping nut.

Advantageously, the run-off securing device according to the disclosure comprises at least one limit stop element, which is provided to limit the first relative motion between the first transmission element and the second transmission element. Particularly preferably, the limit stop element is disposed on a side of the second transmission element that faces toward the first transmission element. In this case, the first transmission element preferably has at least one recess, which is provided to receive the limit stop element. The configuration according to the disclosure advantageously enables limiting an angular range over which the first transmission element is rotatable relative to the second transmission element. In this case, the angular range is, in particular, less than 15°, preferably less than 10°, and particularly preferably less than 7°.

Furthermore, it is proposed that the run-off securing device according to the disclosure has at least one lubricant receiver chamber configured to receive lubricant to reduce a friction in the case of the first relative motion between the first transmission element and the second transmission element. What is achieved, advantageously, is that the first transmission element, in particular the first stroke element, advantageously slides on the second transmission element, in particular on the second stroke element in the form of a ramp, in the case of a relative motion between the tool and the first transmission element, the relative motion being caused by a braking mode of the spindle.

Furthermore proposed is a hand power tool, in particular an angle grinder, comprising a run-off securing device according to the disclosure.

BRIEF DESCRIPTION OF THE DRAWINGS

Further advantages are given by the following description of the drawing. Exemplary embodiments of the disclosure are represented in the drawing. The drawing, the description and the claims contain numerous features in combination. Persons skilled in the art will, expediently, also consider the features individually and combine them to form appropriate, further combinations.

In the drawing.

DETAILED DESCRIPTION

Figure 1:
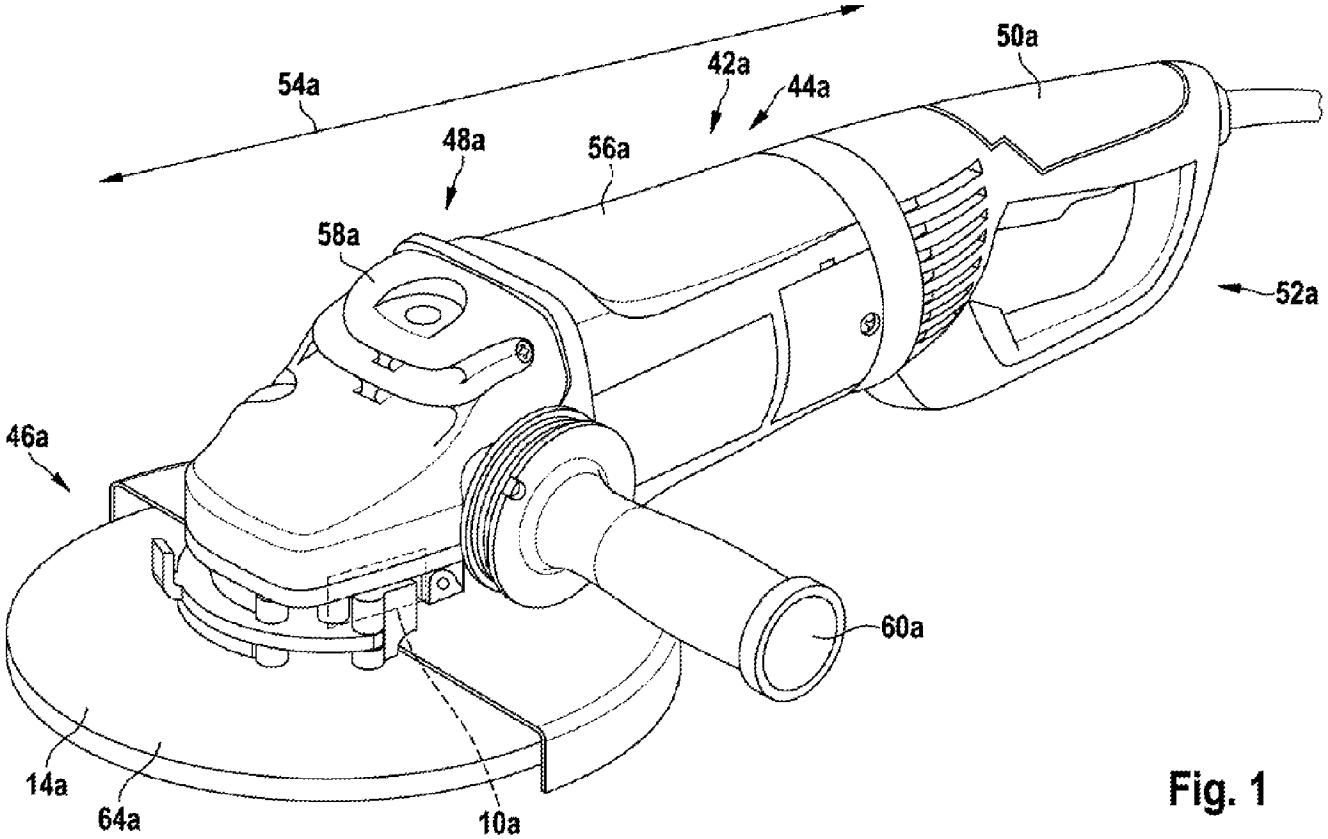
FIG. 1 shows a schematic representation of a hand power tool comprising a run-off securing device according to the disclosure.

FIG. 1, in schematic representation, shows a hand power tool 42*a* as an angle grinder 44*a*, comprising a run-off securing device 10*a* according to the disclosure. The run-off securing device 10*a* in this case is a run-off securing device of a hand power tool. The angle grinder 44*a* comprises a protective hood unit 46*a*, a hand power tool housing 48*a*, and a main handle 50*a* that extends, on a side 52*a* that faces away from a tool 14*a*, in the direction of a main extent direction 54*a* of the angle grinder 44*a*. The hand power tool housing 48*a* comprises a motor housing 56*a* configured to receive an electric motor (not represented in greater detail here), and a gear unit housing 58*a* configured to mount a gear unit (not represented in greater detail here). On the gear unit housing 58*a* there is an auxiliary handle 60*a* disposed on the angle grinder 44*a*. The auxiliary handle 60*a* extends transversely in relation to the main extent direction 54*a* of the angle grinder 44*a*.

Figure 2:
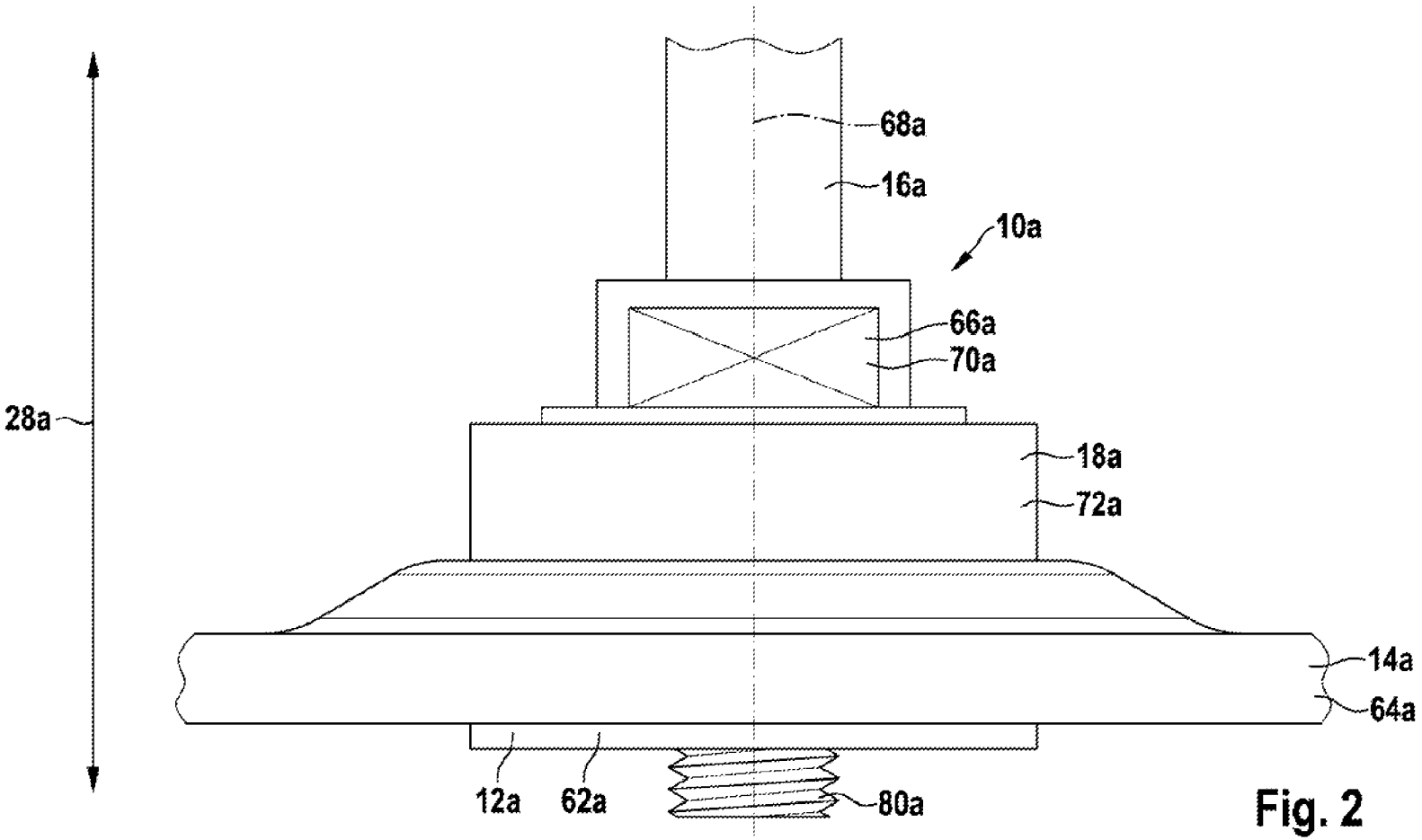
FIG. 2 shows, in a schematic representation, a detail view of a spindle of the hand power tool from FIG. 1, comprising the run-off securing device according to the disclosure disposed on the spindle.

FIG. 2, in a schematic representation, shows a detail view of a spindle 16*a* of the hand power tool 42*a* realized as an angle grinder 44*a*, comprising the run-off securing device 10*a* disposed on the spindle 16*a*. The spindle 16*a* extends perpendicularly in relation to the main extent direction 54*a* out of the gear unit housing 58*a* (not represented in greater detail here). Disposed on the spindle 16*a* is the run-off securing device 10*a* configured to prevent a clamping element 12*a*, realized as a clamping nut 62*a*, and/or the tool 14*a*, realized as a cutting disk 64*a*, from running off the spindle 16*a*. It is also conceivable, however, for the tool 14*a* to be a grinding or polishing disk. To receive the run-off securing device 10*a*, the spindle 16*a* has, on an outer circumference, two flattened portions 66*a* that are disposed diametrically and thus form a double flat 70*a*. In this case, only one of the flattened portions 66*a* is represented in FIG. 2. The outer circumference of the spindle 16*a* is disposed in a plane running perpendicularly in relation to a rotation axis 68*a* of the spindle 16*a*. The gear unit (not represented) and the electric motor (not represented) of the angle grinder 44*a*, enable the spindle 16*a* to be driven so as to be rotatable about the rotation axis 68*a*. While the angle grinder 44*a* is in a working mode, the spindle 16*a* is driven in rotation counter-clockwise as viewed from the angle grinder 44*a*. In this case, the run-off securing device 10*a*, when in a mounted state, is likewise driven in rotation counter-clockwise.

Figure 3:
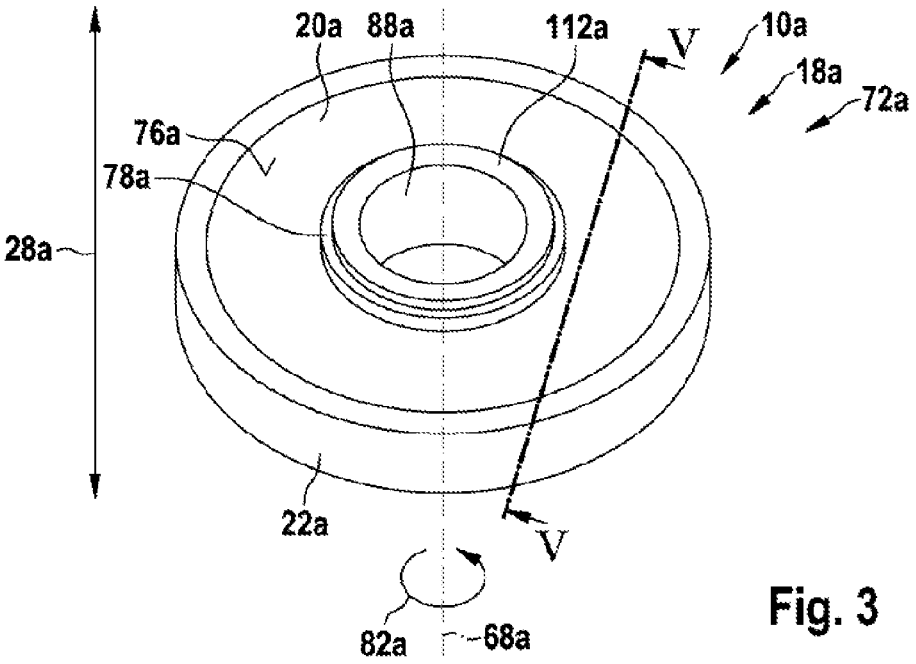
FIG. 3 shows, in a tool-side view, a detail view of the run-off securing device according to the disclosure.
Figure 4:
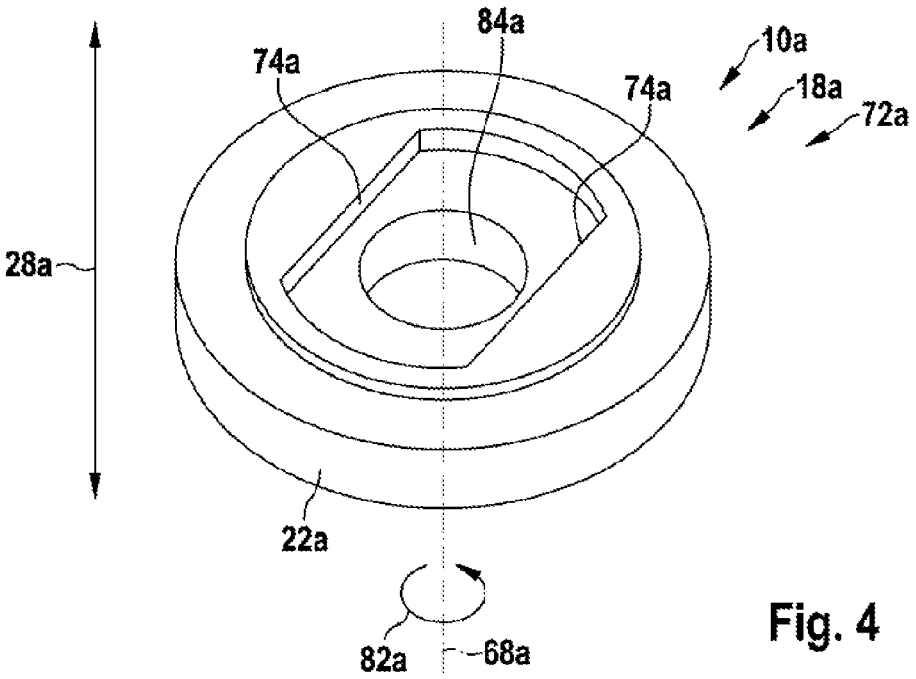
FIG. 4 shows, in a machine-side view, a detail view of the run-off securing device according to the disclosure.

The run-off securing device 10*a* comprises a transmission unit 18*a*, realized as a receiving flange 72*a*, which is provided to be coupled to the spindle 16*a* in a removable manner and which has at least one first transmission element 20*a* and at least one second transmission element 22*a* that is movable relative to the first transmission element 20*a* (FIGS. 3 and 4). When the run-off securing device 10*a* is in a mounted state, the second transmission element 22*a* is positively connected to the spindle 16*a*, for the purpose of transmitting torque. For this purpose, the second transmission element 22*a* has a driving contour 74*a*, which is realized so as to correspond to the double flat 70*a* of the spindle 16*a* (FIG. 4).

Figure 5:
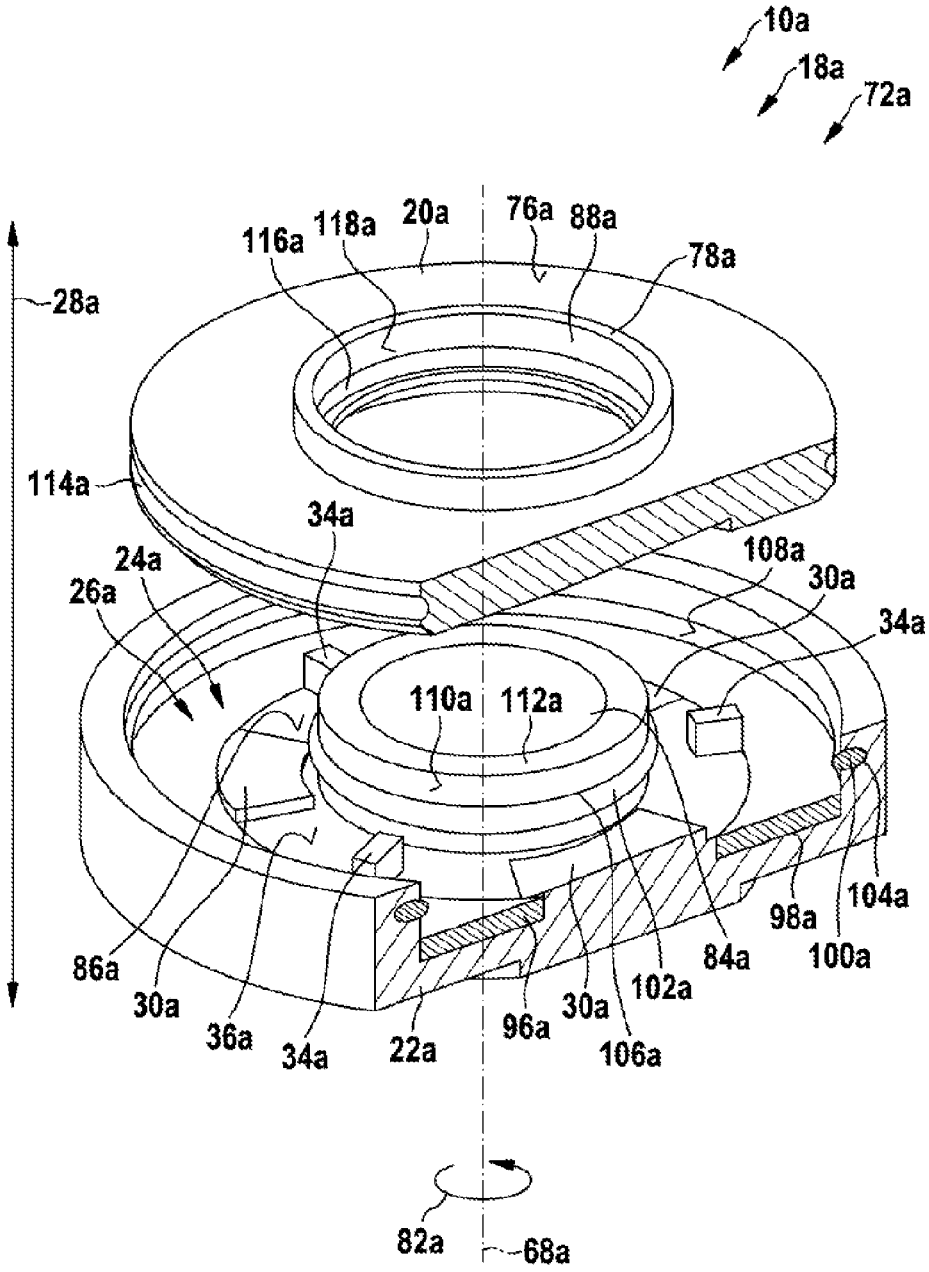
FIG. 5 shows a perspective detail view of the run-off securing device according to the disclosure in an opened state, with a section along the line V-V from FIG. 3.

The first transmission element 20*a* is a disk, and has a bearing contact surface 76*a* configured to bear contact of the tool 14*a* realized as a cutting disk 64*a*. Furthermore, the first transmission element 20*a* has an annular collar 78*a*, which is provided to receive the tool 14*a* (FIGS. 3 and 5). For this purpose, the tool 14*a* has a central opening, realized as a bore (not represented in greater detail here), which is pushed onto the collar 78*a* of the first transmission element 20*a* to mount the tool 14*a*, such that the tool 14*a* bears on the bearing contact surface 76*a* of the first transmission element 20*a*. The bearing contact surface 76*a* of the first transmission element 20*a* and a side of the tool 14*a* that bears on the bearing contact surface 76*a* have an adhesive coating (not represented in greater detail here), such that there is a large amount of friction between the bearing contact surface 76*a* of the first transmission element 20*a* and the side of the tool 14*a* that bears on the bearing contact surface 76*a*. It is also conceivable, however, that the bearing contact surface 76*a* and the side of the tool 14*a* that bears on the bearing contact surface 76*a* have corresponding, ramp-type geometries that engage in each other. Likewise conceivable are other friction-increasing measures considered appropriate by persons skilled in the art, as well as other configurations of the bearing contact surface 76*a* and of the side of the tool 14*a* that bears on the bearing contact surface 76*a*.

When the tool 14*a* is being mounted, the tool 14*a*, via the central opening, is pushed along an axial direction 28*a* onto the spindle 16*a*, until the tool 14*a* bears on the bearing contact surface 76*a* of the first transmission element 20*a* of the transmission unit 18*a* of the run-off securing device 10*a* that is already disposed on the spindle 16*a*. With an internal thread (not represented in greater detail here) of the clamping element 12*a*, the clamping element 12*a*, realized as a clamping nut 62*a*, is then screwed onto a thread 80*a* of the spindle 16*a*. The tool 14*a* is thus clamped, together with the transmission element 18*a*, on the spindle 16*a*, the transmission element 18*a* being supported on the spindle 16*a* via the second transmission element 22*a*. Via the clamping of the tool 14*a* between the clamping element 12*a* and the transmission unit 18*a* on the spindle 16*a*, a torque is transmitted from the spindle 16*a* onto the tool 14*a*. When the angle grinder 44*a* is in working mode, the tool 14*a* is driven in rotation counter-clockwise as viewed from the angle grinder 44*a*. When the angle grinder 44*a* is in working mode, the clamping element 12*a* is moved further along the spindle 16*a* in the direction of the angle grinder 44*a* by a rotation of the tool 14*a* and a friction between the clamping element 12*a* and a side of the tool 14*a* that bears on the clamping element 12*a*, by a pitch of the thread 80*a* of the spindle 16a and the internal thread of the clamping element 12*a*, such that a strong clamping force is produced to hold the tool 14*a* on the spindle 16*a*.

The angle grinder 44*a* comprises a braking device (not represented in greater detail here) configured to prevent the spindle 16*a* from coasting down in the case of an operation to switch off the angle grinder 44*a* by an interruption of an electric power supply through actuation of a switch (not represented in greater detail here). Upon the switching-off operation, the angle grinder 44*a* switches to a braking mode and brakes the spindle 16*a* with the braking device. In the braking mode, owing to the mass inertia the tool 14*a* continues to move counter-clockwise, or continues to move about the rotation axis 68*a* of the spindle 16*a*, such that a torque difference is produced between the tool 14*a*, the spindle 16*a*, the transmission unit 18*a* and the clamping element 12*a*. This torque difference results in a relative motion between the tool 14*a*, the transmission unit 18*a* and the clamping element 12*a*. Owing to a friction between the clamping element 12*a* and the inert tool 14*a*, the clamping element 12*a* is rotated concomitantly with the tool 14*a*, contrary to a direction of rotation generated when the angle grinder 44*a* is in working mode, such that a thread bias generated by the pitch of the internal thread of the clamping element 12*a* and of the thread 80*a* of the spindle 16*a* is removed. As a result of this, the clamping element 12*a* is released over an entire thread length of the thread 80*a* of the spindle 16*a*, and the clamping element 12*a*, together with the tool 14*a*, is able to run off the spindle 16*a*. To prevent the clamping element 12*a* and/or the tool 14*a* from running off, the transmission unit 18*a*, realized as a receiving flange 72*a*, has a motion changing unit 24*a*, which is provided to transform a first relative motion between the first transmission element 20*a* and the second transmission element 22*a* into a second relative motion in a braking mode (FIG. 5). In this case, the first relative motion between the first transmission element 20*a* and the second transmission element 22*a* is a rotation about the rotation axis 68*a*. The second relative motion between the first transmission element 20*a* and the second transmission element 22*a* is a translation along the axial direction 28*a*. The rotation between the first transmission element 20*a* and the second transmission element 22*a* is produced, when in the braking mode, from the torque difference between the tool 14*a* and the transmission unit 18*a*. Owing to the resultant friction between the tool 14*a* and the bearing contact surface 76*a* of the first transmission element 20*a*, the tool 14*a* concomitantly rotates the first transmission element 20*a*, the second transmission element 22*a* being positively connected to the double flat 70*a* of the spindle 16*a* by the driving contour 74*a*. The first transmission element 20*a* in this case is movably mounted in the second transmission element 22*a*, which is a pot. The first transmission element 20*a* is mounted in the second transmission element 22*a* so as to be movable along a circumferential direction 82*a* and along the axial direction 28*a*.

Figure 6:
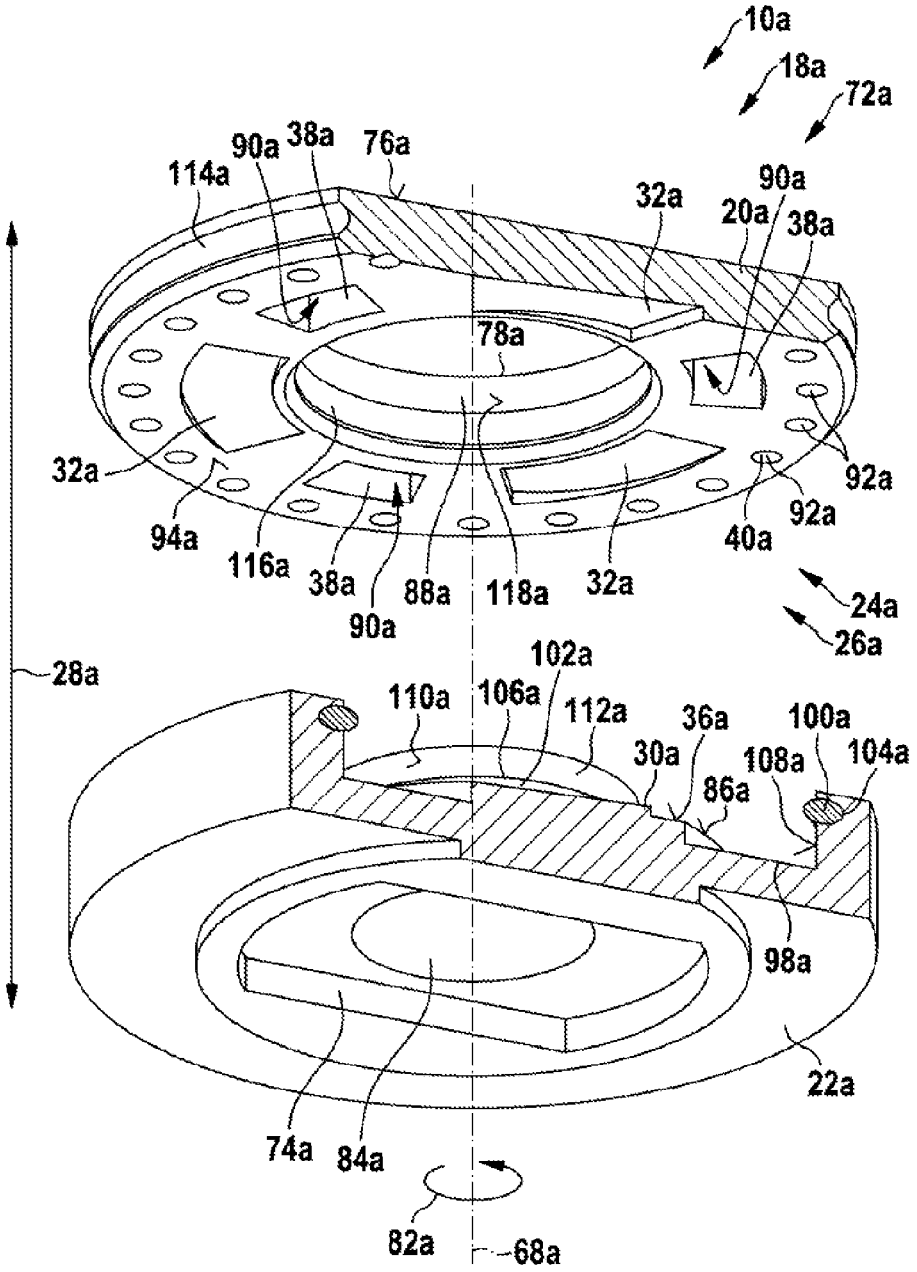
FIG. 6 shows a further perspective detail view of the run-off securing device according to the disclosure in an opened state, with a section along the line V-V from FIG. 3.

The motion changing unit 24*a* is a stroke unit 26*a*, which is provided to move the first transmission element 20*a* along the axial direction 28*a* as a result of the first relative motion, in particular the rotation, relative to the second transmission element 22*a*. The stroke unit 26*a* has a first stroke element 30*a*, which is integral with the second transmission element 22*a*. The first stroke element 30*a* is in the form of a ramp. Further, the stroke unit 26*a* has a second stroke element 32*a*, which generates the second relative motion, or the translation of the first transmission element 20*a* relative to the second transmission element 22*a*, as a result of the first relative motion, or the rotation of the first transmission element 20*a* relative to the second transmission element 22*a*, by an action in combination with the first stroke element 30*a*. The second stroke element 32*a* is likewise in the form of a ramp, and is integral with the first transmission element 20*a* (FIG. 6). In total, the first transmission element 20*a* has three second stroke elements 32*a*. The second transmission element 22*a* has three first stroke elements 30*a*, which correspond with the three second stroke elements 32*a* of the first transmission element 20*a*. It is also conceivable, however, for a number greater or less than three stroke elements 30*a*, 32*a* to be provided on the first transmission element 20*a* and on the second transmission element 22*a*. Depending on the requirement, persons skilled in the art will decide which number of stroke elements 30*a*, 32*a* is considered appropriate on the first transmission element 20*a* and on the second transmission element 22*a*.

The first stroke elements 30*a* extend in a uniformly distributed manner on a circular ring of 360° of the second transmission element 22*a*, along an angular range of between 30° and 60° in each case, around a central opening 84*a* of the second transmission element 22*a*, which opening is provided to receive the spindle 16*a*. The central opening 84*a* in this case is realized as a fit bore. The first stroke elements 30*a* have a pitch that, starting from a start point disposed on an inner surface 86*a*, extends in the direction of an end point disposed in a plane parallel to the inner surface 86*a*. When the second transmission element 22*a* is in the mounted state, the plane is disposed at a distance from the inner surface 86*a*, going from the spindle 16*a* in the direction of the mounted tool 14*a*.

The second stroke elements 32*a* extend in a uniformly distributed manner on a circular ring of 360° of the first transmission element 20*a*, along an angular range of between 30° and 60° in each case, around a central opening 88*a* of the first transmission element 20*a*, which opening is provided to receive the spindle 16*a* (FIG. 6). When the transmission unit 18*a* is in a mounted state, the second stroke elements 32*a* face in the direction of the inner surface 86*a* of the second transmission element 22*a*. The second stroke elements 32*a* have a pitch corresponding to the first stroke elements 30*a*. The pitch of the first stroke elements 30*a* and of the second stroke elements 32*a* in this case is as great as or greater than a pitch of the thread 80*a* of the spindle 16*a*, or of the internal thread of the clamping element 12*a*. When the tool 14*a* is in a clamped state, the second stroke elements 32*a* bear on the first stroke elements 30*a*. Upon the rotation of the first transmission element 20*a* relative to the second transmission element 22*a*, as a result of the braking mode, the second stroke elements 32*a* slide on the first stroke elements 30*a*. An axial stroke of the first transmission element 20*a* relative to the second transmission element 22*a* is thus generated along the axial direction 28*a*. This axial stroke generates a clamping force in the direction of the tool 14*a* and of the clamping element 12*a*, such that the clamping element 12*a* and/or the tool 14*a* is prevented from running off the spindle 16*a*.

The run-off securing device 10*a* comprises at least one limit stop element 34*a*, which is provided to limit the first relative motion between the first transmission element 20*a* and the second transmission element 22*a*, or the rotation of the first transmission element 20*a* relative to the second transmission element 22*a* (FIG. 5). The limit stop element 34*a* is disposed on the inner surface 86*a* of the second transmission element 22*a* that is constituted by a side 36*a* facing toward the first transmission element 20*a*. The first transmission element 20*a* in this case has at least one recess 38*a* (FIG. 6), which is provided to receive the limit stop element 34*a* when the transmission unit 18*a* is in a mounted state. In total, the run-off securing device 10*a* comprises three limit stop elements 34*a* on the second transmission element 22*a*, and three recesses 38*a* on the first transmission element 20*a*. It is conceivable, however, for a number greater or less than three limit stop elements 34*a* to be provided on the second transmission element 22*a* and for a number greater or less than three recesses 38*a* to be provided on the first transmission element 20*a*. Depending on the requirement, persons skilled in the art will decide which number of limit stop elements 34*a* is considered appropriate on the second transmission element 22*a* and which number of recesses 38*a* is considered appropriate on the first transmission element 20*a*.

The three limit stop elements 34*a* are disposed in a uniformly distributed manner along the circular ring of 360°, spaced apart from each other and spaced apart from the three first stroke elements 30*a* of the second transmission element 22*a*. Further, the three limit stop elements 34*a* have axial extents that run along the axial direction 28*a*. The axial extents in this case are selected in such a way that, when the transmission unit 18*a* is in a mounted state, the three limit stop elements 34*a* extend at least into the three recesses 38*a* of the first transmission element 20*a*. The three recesses 38*a* extend in a uniformly distributed manner on the circular ring of 360° of the first transmission element 20*a*, in each case along an angular range of between 15° and 30°, and, spaced apart in relation to each other and to the second stroke elements 32*a*, are disposed around the central opening 88*a* of the first transmission element 20*a*.

The limit stop elements 34*a* limit the rotation between the first transmission element 20*a* and the second transmission element 22*a* to an angular range defined by a dimension of the recesses 38*a* and by a dimension of the limit stop elements 34*a*. This allows deliberate release of the clamping element 12*a*, for example during a tool change. When the clamping element 12*a* is rotated clockwise, or contrary to the rotation direction, as viewed from the angle grinder 44*a*, in working mode, the first transmission element 20*a* is turned relative to the second transmission element 22*a*, until the limit stop elements 34*a* of the second transmission element 22*a* stop against peripheral regions 90*a* of the recesses 38*a* of the first transmission element 20*a*. The stopping, or a bearing of the limit stop elements 34*a* against the peripheral regions 90*a* of the recesses 38*a*, allows the first transmission element 20*a* to fixedly couple to the second transmission element 22*a*. A torque generated by unscrewing the clamping element 12*a* is supported, via the driving contour 74*a*, on the double flat 70*a* of the spindle 16*a*, and the clamping element 12*a* is configured to be released and unscrewed from the spindle 16*a*.

Furthermore, the run-off securing device 10*a* has at least one lubricant receiver chamber 40*a* configured to receive lubricant to reduce a friction in the case of the first relative motion between the first transmission element 20*a* and the second transmission element 22*a*. The lubricant receiver chamber 40*a* is constituted by a lubricant pocket 92*a*. In total, a plurality of lubricant pockets 92*a* are disposed, uniformly spaced apart from each other, along a circular ring around the central opening 88*a* of the first transmission element 20*a* (FIG. 6). The lubricant pockets 92*a* are disposed in a side 94*a* of the first transmission element 20*a* that faces away from the bearing contact surface 76*a*. Further, lubricant pockets (not represented in greater detail here) are likewise disposed in the ramp-type first stroke elements 30*a* and in the ramp-type second stroke elements 32*a*, such that a lesser frictional resistance is produced as the ramp-shaped first stroke elements 30*a* slide on the ramp-shaped second stroke elements 32*a* during a rotation of the first transmission element 20*a* relative to the second transmission element 22*a*.

Furthermore, the second transmission element 22*a* has a bearing element 96*a*, which is disposed in a circular ring-shaped recess 98*a* in the inner surface 86*a* of the second transmission element 22*a*. The bearing element 96*a* is a plain bearing in this case. In an alternative design, however, it is conceivable for the bearing element 96*a* to be a rolling bearing. Also disposed in the circular ring-shaped recess 98*a* are a plurality of lubricant pockets (not represented in greater detail here), uniformly spaced apart from each other, configured to receive lubricant.

The transmission unit 18*a* additionally has a first sealing element 100*a* and a second sealing element 102*a*, which are provided to protect the transmission unit 18*a* from the ingress of dust from an external environment and to prevent lubricant from emerging from the inside. The first sealing element 100*a* in this case is disposed in a first groove 104*a* of the second transmission element 22*a*, and the second sealing element 102*a* is disposed in a second groove 106*a* of the second transmission element 22*a* (FIG. 5). The first groove 104*a* is disposed in a side surface 108*a* of the second transmission element 22*a*. The side surface 108*a* extends perpendicularly in relation to the inner surface 86*a* of the second transmission element 22*a* and along an entire circumference of the second transmission element 22*a*, which circumference runs in a plane parallel to the inner surface 86*a*. The second groove 106*a* is disposed in a side 110*a* of a hollow cylinder 112*a* that surrounds the central opening 84*a*, which side faces toward the side surface 108*a*. The first sealing element 100*a* is pressed with an exact fit into the first groove 104*a*, and the second sealing element 102*a* is pressed with an exact fit into the second groove 106*a*.

The first transmission element 20*a* has a first sealing element receiver 114*a* that corresponds to the first groove 104*a* of the second transmission element 22*a*. The first sealing element receiver 114*a* is disposed along an outer circumference of the first transmission element 20*a* and extends along the entire outer circumference. The outer circumference of the first transmission element 20*a* runs in a plane that extends parallel to the bearing contact surface 76*a*. In this case, the first sealing element receiver 114*a* has an extent, along the axial direction 28*a*, that is greater than an extent of the first sealing element 100*a* along the axial direction 28*a*. A sealing function is thereby ensured in the case of an axial stroke of the first transmission element 20*a* relative to the second transmission element 22*a*.

Further, the first transmission element 20*a* has a second sealing element receiver 116*a* that corresponds to the second groove 106*a* of the second transmission element 22*a*. The second sealing element receiver 116*a* is disposed in an inside 118*a* of the central opening 88*a* of the first transmission element 20*a* and extends along an entire circumference of the central opening 88*a*. The circumference of the central opening 88*a* runs in a plane that extends parallel to the bearing contact surface 76*a* of the first transmission element 20*a*. The second sealing element receiver 116*a* has an extent along the axial direction 28*a* that is greater than an extent of the second sealing element 102*a* along the axial direction 28*a*. A sealing function is likewise thereby ensured in the case of an axial stroke of the first transmission element 20*a* relative to the second transmission element 22*a*. The first sealing element 100*a* and the second sealing element 102*a* enable the first transmission element 20*a* and the second transmission element 22*a* to be connected to each other and fixed axially.

Figure 7:
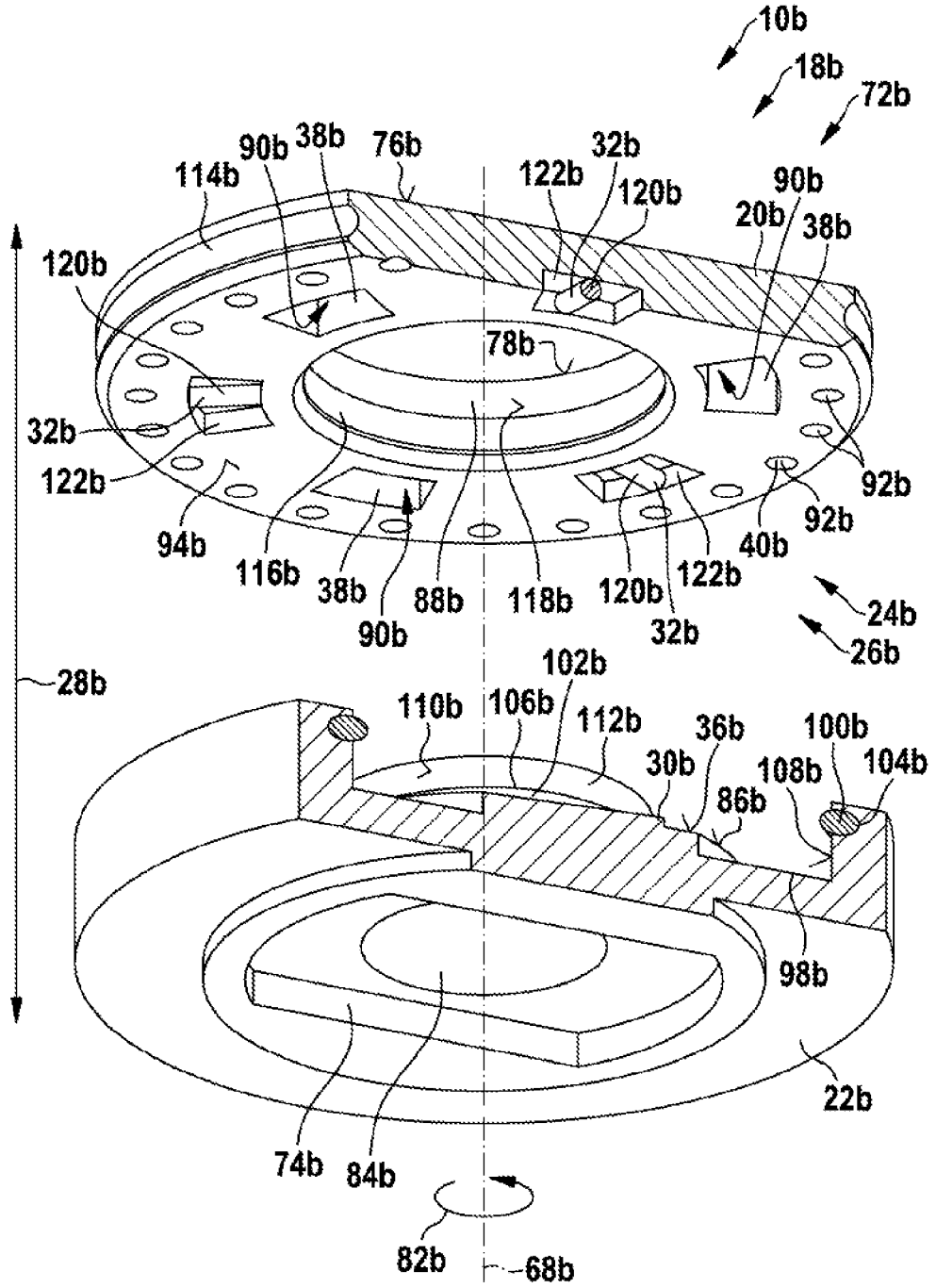
FIG. 7 shows a perspective detail view of an alternative run-off securing device according to the disclosure in an opened state, with an analogous section according to the line V-V from FIG. 3.

A second, alternative exemplary embodiment is represented in FIG. 7. Components, features and functions that remain substantially the same are denoted, basically, by the same references. To distinguish the exemplary embodiments, the letters a and b have been added to the references of the exemplary embodiments. The description that follows is limited substantially to the differences in relation to the first exemplary embodiment in FIGS. 1 to 6 and, in respect of components, features and functions that remain the same, reference may be made to the description of the first exemplary embodiment in FIGS. 1 to 6.

FIG. 7 shows a perspective detail view of an alternative run-off securing device 10*b* according to the disclosure in an opened state, with an analogous section according to the line V-V from FIG. 3. The run-off securing device 10*b* in this case is disposed on a spindle of an angle grinder 44*a*, such as that shown in FIG. 1. The run-off securing device 10*b* comprises a transmission unit 18*b*, which is provided to be coupled to the spindle in a removable manner, and which has at least one first transmission element 20*b* and at least one second transmission element 22*b* that is movable relative to the first transmission element 20*b*. Furthermore, the transmission unit 18*b* comprises at least one motion changing unit 24*b*, realized as a stroke unit 26*b*, which is provided, in a braking mode, to at least partially transform a first relative motion between the first transmission element 20*b* and the second transmission element 22*b* into a second relative motion.

The stroke unit 26*b* has at least one first ramp-shaped stroke element 30*b*, which is realized so as to be integral with the second transmission element 22*b*. In total, the stroke unit 26*b* has three first stroke elements 30*b*, which are realized so as to be integral with the second transmission element 22*b*. Further, the stroke unit 26*b* has at least one second stroke element 32*b*, which is disposed on a side 94*b* of the first transmission element 20*b* that faces away from a bearing contact surface 76*b*. In total, the stroke unit 26*b* has three second stroke elements 32*b*. The second stroke elements 32*b* are realized as roll bodies 120*b*. The roll bodies 120*b* are disposed in recesses 122*b* in the side 94*b* of the first transmission element 20*b* that faces away from the bearing contact surface 76*b*. The recesses 122*b* are disposed along a circular ring, in a uniformly distributed manner and spaced apart from each other, in the first transmission element 20*b*. The roll bodies 120*b* of the first transmission element 20*b* correspond with the ramp-shaped first stroke elements 30*b* of the second transmission element 22*b*. In an alternative design, however, it is conceivable for the first stroke elements 30*b* to be realized so as to be integral with the first transmission element 20*b*, and for the roll bodies 120*b* to be disposed on the second transmission element 22*b*.

Upon a rotation of the first transmission element 20*b* relative to the second transmission element 22*b*, as a result of a braking mode, the roll bodies 120*b* roll along the ramp-shaped first stroke elements 30*b* and thus generate an axial stroke along an axial direction 28*b* of the first transmission element 20*b* relative to the second transmission element 22*b*.

The invention claimed is:

1. A run-off securing device for securing against runoff of a tool mounted on a power tool, the run-off securing device comprising:

a spindle configured to mount the tool onto the power tool; and at least one transmission unit configured to be removably coupled to the spindle, the at least one transmission unit including:

at least one first transmission element;

at least one second transmission element that is positively connected to the spindle for rotation with the spindle, wherein:

in a working mode, the at least one second transmission is configured to transmit torque from rotation of the spindle to the at least one first transmission element, and the first transmission element is configured to transmit the torque to the tool; and in a braking mode for slowing the rotation of the spindle, which results in a torque difference between the tool and the at least one second transmission element due to an inertia of the tool, the at least one second transmission element is configured to move in a first relative motion relative to the first transmission element due to the torque difference; and at least one motion changing unit configured to at least partially transform the first relative motion into a second relative motion while the rotation of the spindle is slowing down in the braking mode.

2. The run-off securing device as claimed in claim 1, wherein the first relative motion is a rotation.

3. The run-off securing device as claimed in claim 1, wherein the second relative motion is a translation.

4. The run-off securing device as claimed in claim 1, wherein the first transmission element is movably mounted in the second transmission element.

5. The run-off securing device as claimed in claim 1, wherein the motion changing unit is a stroke unit configured to move the first transmission element as a result of the first relative motion relative to the second transmission element, along an axial direction.

6. The run-off securing device as claimed in claim 5, wherein the stroke unit has at least one first stroke element, configured to be at least partially integral with the first transmission element or with the second transmission element.

7. The run-off securing device as claimed in claim 6, wherein the first stroke element is in the form of a ramp.

8. The run-off securing device as claimed in claim 6, wherein the stroke unit has at least one second stroke element configured to generate the second relative motion as a result of the first relative motion by an action in combination with the first stroke element.

9. The run-off securing device as claimed in claim 1, further comprising at least one limit stop element limit the first relative motion between the first transmission element and the second transmission element.

10. A run-off securing device comprising:

a spindle;

at least one transmission unit configured to be removably coupled to the spindle, the at least one transmission unit including:

at least one first transmission element at least one second transmission element that is movable relative to the first transmission element; and at least one motion changing unit configured to at least partially transform a first relative motion into a second relative motion in a braking mode; and at least one limit stop element configured to limit the first relative motion between the first transmission element and the second transmission element, wherein the limit stop element is disposed on a side of the second transmission element that faces toward the first transmission element.

11. The run-off securing device at least as claimed in claim 9, wherein the first transmission element has at least one recess configured to receive the limit stop element.

12. The run-off securing device as claimed in claim 1, further comprising at least one lubricant receiver chamber configured to receive lubricant to reduce a friction in the first relative motion between the first transmission element and the second transmission element.

13. A hand power tool comprising:

a run-off securing device comprising:

a spindle configured to mount the tool onto the power tool; and at least one transmission unit configured to be removably coupled to the spindle, the at least one transmission unit including:

at least one first transmission element at least one second transmission element that is positively connected to the spindle for rotation with the spindle, wherein:

in a working mode, the at least one second transmission is configured to transmit torque from rotation of the spindle to the at least one first transmission element, and the first transmission element is configured to transmit the torque to the tool; and in a braking mode for slowing the rotation of the spindle, which results in a torque difference between the tool and the at least one second transmission element due to an inertia of the tool, the at least one second transmission element is configured to move in a first relative motion relative to the first transmission element due to the torque difference; and at least one motion changing unit configured to at least partially transform the first relative motion into a second relative motion while the rotation of the spindle is slowing down in the braking mode.

14. The run-off securing device as claimed in claim 1, wherein the limit stop element is disposed on a side of the second transmission element that faces toward the first transmission element.

* * * * *

UNITED STATES PATENT AND TRADEMARK OFFICE

CERTIFICATE OF CORRECTION

PATENT NO. : 9,033,767 B2
APPLICATION NO. : 13/636308
DATED : May 19, 2015
INVENTOR(S) : Joachin Schadow It is certified that error appears in the above-identified patent and that said Letters Patent is hereby corrected as shown below:

IN THE CLAIMS

In column 11, lines 55-58, claim 9 should read as follows:

9. The run-off securing device as claimed in claim 1, further comprising at least one limit stop element configured to limit the first relative motion between the first transmission element and the second transmission element.

Signed and Sealed this
Fifth Day of January, 2016

Michelle K. Lee

Michelle K. Lee
*Director of the United States Patent and Trademark Office*